US008002013B2

(12) United States Patent
Brown et al.

(10) Patent No.: US 8,002,013 B2
(45) Date of Patent: Aug. 23, 2011

(54) CEILING VENT DIFFUSER

(75) Inventors: Chad A. Brown, Toronto (CA); Robert G. Dickie, Newmarket (CA)

(73) Assignee: Airvisor Inc., Toronto, Ontario (CA)

( * ) Notice: Subject to any disclaimer, the term of this patent is extended or adjusted under 35 U.S.C. 154(b) by 624 days.

(21) Appl. No.: 12/062,239

(22) Filed: Apr. 3, 2008

(65) Prior Publication Data

US 2009/0253366 A1 Oct. 8, 2009

(51) Int. Cl.
*A47H 13/00* (2006.01)
*A47G 5/00* (2006.01)

(52) U.S. Cl. ..... 160/368.1; 160/351; 454/299; 454/316; 454/333

(58) Field of Classification Search ..... 454/229, 454/316, 275, 270, 292, 295, 307, 308, 358, 454/333; 160/368.1
See application file for complete search history.

(56) References Cited

U.S. PATENT DOCUMENTS

| | | | | | |
|---|---|---|---|---|---|
| 1,450,819 | A | * | 4/1923 | Sammes | 454/358 |
| 1,939,294 | A | * | 12/1933 | Dixon | 454/226 |
| 1,975,686 | A | * | 10/1934 | Froelich | 454/307 |
| 2,127,072 | A | * | 8/1938 | Tinnerman | 24/453 |
| RE23,560 | E | * | 9/1952 | Herbster | 49/41 |
| 2,761,371 | A | * | 9/1956 | Parrish | 49/51 |
| 2,784,659 | A | * | 3/1957 | De Roo et al. | 454/310 |
| 3,046,866 | A | * | 7/1962 | Straub et al. | 454/310 |
| 3,768,235 | A | * | 10/1973 | Meyer et al. | 55/385.5 |
| 4,010,518 | A | * | 3/1977 | Rejeski et al. | 285/420 |
| 4,602,556 | A | * | 7/1986 | Gladden | 454/307 |
| 4,815,934 | A | | 3/1989 | Rademaker | |
| 5,213,543 | A | * | 5/1993 | Clarino | 454/292 |
| 5,297,326 | A | * | 3/1994 | Kline | 29/401.1 |
| 5,410,782 | A | * | 5/1995 | Holyoake | 24/505 |
| 6,010,402 | A | * | 1/2000 | Schmidt | 454/300 |
| 6,840,852 | B2 | | 1/2005 | Gehring et al. | |
| 7,635,298 | B2 | * | 12/2009 | Henneberry | 454/307 |
| 2006/0040607 | A1 | * | 2/2006 | Perez et al. | 454/358 |
| 2007/0181271 | A1 | * | 8/2007 | Earnest | 160/368.1 |

FOREIGN PATENT DOCUMENTS

GB 1085389 9/1967

OTHER PUBLICATIONS

Ruskin Air Management Limited, Perforated Face Ceiling Diffuser catalog, Aug. 2005, www.riskinuk.co.uk, pp. 3, 4, 7.*

* cited by examiner

*Primary Examiner* — Steven B McAllister
*Assistant Examiner* — Phillip E Decker
(74) *Attorney, Agent, or Firm* — Sand & Sebolt

(57) ABSTRACT

A device for altering the airflow pattern from a ceiling vent diffuser. The device comprises a flexible member that is secured to a diffuser vane by a spring-biased hook and one or more tabs. A release button on the outer surface of the device is depressed to pivot the hook out of engagement with the vane. The device is complementary shaped to a region of the diffuser. When installed, the device blocks the openings in that region and substantially prevents air from flowing out of the openings. One or more devices may be installed in selected regions to block airflow from those selected regions. A plurality of devices may be utilized to completely prevent airflow from the diffuser.

18 Claims, 7 Drawing Sheets

CEILING VENT DIFFUSER

BACKGROUND OF THE INVENTION

1. Technical Field

This invention generally relates to air circulation systems for buildings. More particularly, the invention relates to ceiling vents. Specifically, the invention relates to a cover that is detachably connectable to a ceiling vent diffuser to block airflow from a region of the diffuser.

2. Background Information

Most industrial and commercial buildings have 24"×24" square ceiling vent diffusers that are mounted on drywall or T-bar ceilings. Occasionally, buildings may be provided with circular vent diffusers, but these are less common than the square version. The vent diffusers are standardized to fit in the 24" T-bar ceiling spacing and can be made with three or four vents through which heated or cooled air is introduced into the room. The diffusers alter the direction of the air flowing out of the vent so that the air does not flow straight down into the room and at right angles to the ceiling. Instead, the diffuser causes the air to flow outwardly equally in all directions and through 360 degrees from the vent. Initially, the air is blown generally along a portion of a ceiling and eventually drops into the room at a distance from the vent itself.

When heating and air-conditioning contractors are designing and installing heating and cooling systems, their main focus is the overall balance of heating and cooling circulation in any particular area of the building. The contractor will add butterfly type air flow controllers in the pipe that connects to the top of the diffuser. The flow valves for the system are adjusted in an attempt to give the building as constant a temperature as possible. The contractors typically install, test and adjust the heating and cooling system before any furniture or employees are housed in the building. When employees are finally settled into the premises, they may discover that they have hot or cold air blowing directly onto them from vents located in close proximity to their desks. This situation may lead to much discomfort on the part of the employees who may try to minimize their discomfort by shutting the vent or taping cardboard or some other material over the same. Another possible solution is for a company that maintains the system to remove the diffuser and adjust the airflow butterfly valve to reduce the overall flow of air through the diffuser. This adjustment of the butterfly valve does not affect the direction of the flow but, instead, affects the volume of air flowing through the vent. This airflow reduction may make life more pleasant for the employee sitting close to the vent but it can also have negative implications for the overall temperature of the building.

There is therefore a need in the art for a device and method that allows for quick and easy adjustment of the airflow through a vent diffuser.

SUMMARY OF THE INVENTION

The device of the present invention comprises a cover that is selectively engageable with a vent diffuser to allow for directional adjustment of the airflow through the vent without affecting the volume of air flowing outwardly from the same. The device comprises a flexible member that is secured to a diffuser vane by a spring-biased hook and one or more tabs. A release button on the outer surface of the device is depressed to pivot the hook out of engagement with the vane.

The device is complementary shaped to a region of the diffuser. If a typical square diffuser is viewed from the position of the mouth of the vent pipe to which the diffuser is attached, then the diffuser may be considered to have four directional quadrants out of which air flows. Those quadrants are effectively directed toward the north, the south, the east and the west. Under normal operating conditions, air radiates outwardly and downwardly from the vent and through the diffuser in all four quadrants. The device of the present invention provides a mechanism for blocking airflow in a selected one of the quadrants. When installed, the device blocks the openings in that region and substantially prevents air from flowing out of the openings. The device can be quickly and easily installed and removed and thereby allows for rapid blocking of the airflow in any one direction from the diffuser. The airflow out of the remaining three quadrants is increased proportionately, but the overall volume of air flowing out of the vent is not reduced. Consequently, the airflow at a particular workstation, for example, may be effectively blocked, but the overall temperature of the building is relatively unaffected.

One or more devices may be installed in selected regions to block airflow from those selected regions. A plurality of devices may be utilized to completely prevent airflow from the diffuser.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
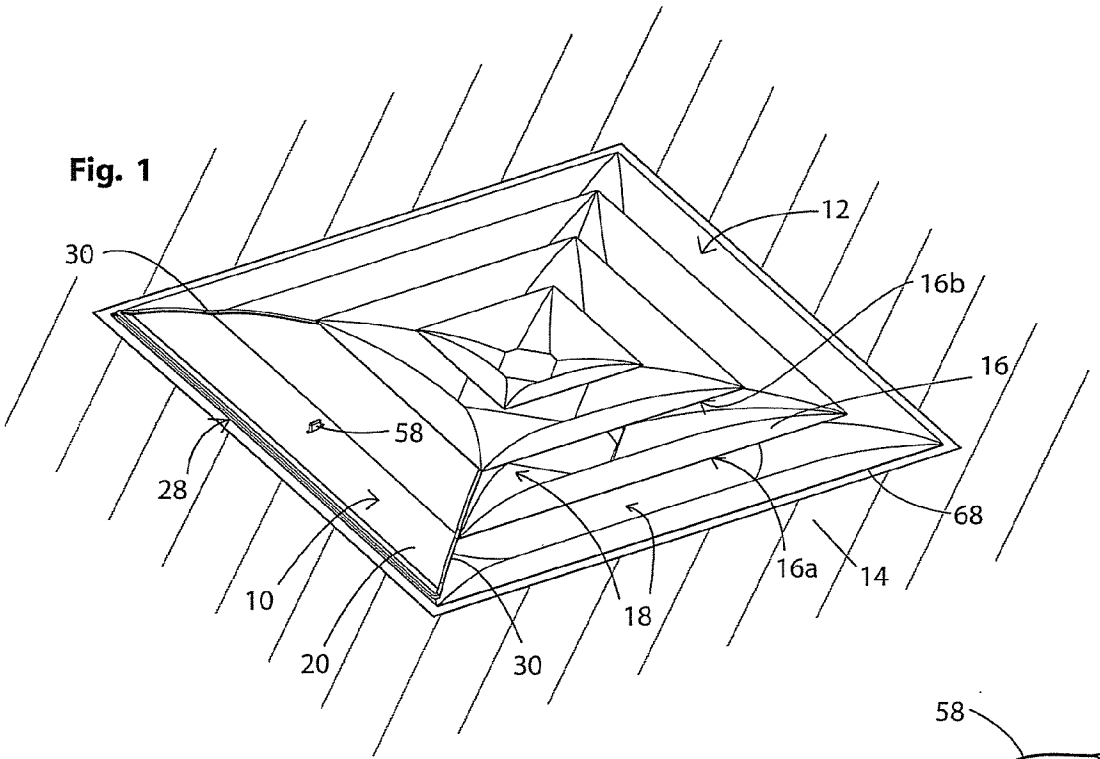
FIG. 1 is a perspective front view of a four-vane diffuser installed on a ceiling, with the diffuser having a cover in accordance with the present invention installed thereon.

Referring to FIGS. 1-14 there is shown a vent diffuser cover in accordance with the present invention and generally indicated at 10. Cover 10 is designed to be engaged with a vent diffuser 12 to change the airflow pattern therefrom. The vent diffuser 12 is positioned in front of a vent (not shown) in the ceiling 14 and typically is either square or circular in shape. Diffuser 12 is shown as having four vanes 16 and openings 18 therebetween through which air can flow.

In accordance with a specific feature of the present invention, cover 10 comprises a flexible member 20 that preferably is manufactured from a plastic material. Flexible member 20 may be transparent so that it is not easily noticed on vent diffuser 12 or may be opaque and colored so that it blends into vent diffuser 12 or colored so that it is easily seen.

Flexible member 20 has an inner surface 22, an outer surface 24, interior edge 26, exterior edge 28 and side edges 30. Interior edge 26 is shorter in length than is exterior edge 28. Consequently, flexible member 20 tapers from exterior edge 28 to interior edge 26 and has the shape of a truncated triangle.

Figure 6:
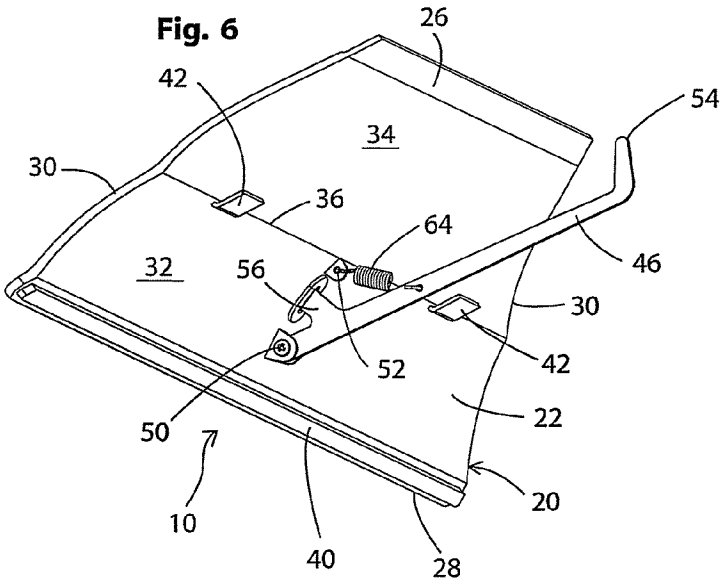
FIG. 6 is a perspective rear view of the vent cover showing the locking mechanism.

As shown in FIG. 6, flexible member 20 is generally planar but is molded to have a first region 32 and a second region 34 that meet along a shallow ridge 36. Each of the first and second regions 32, 34 has a shallow arcuate profile when viewed from the side. This configuration of first and second regions 32, 34 gives flexible member 20 a spring memory. Interior edge 26 is thinned slightly relative to the rest of flexible member 20, thereby creating a lip 38 that runs along the entire length of interior edge 26. Lip 38 forms a part of outer surface 24 of flexible member 20. A seal, comprising an adhesive foam strip 40, is secured to inner surface 22 of flexible member 20 and along exterior edge 28 thereof.

One or more tabs 42 are provided on inner surface 22 of cover 10. Tabs 42 extend from inner surface 22 and are spaced apart from each other. Preferably tabs 42 extend outwardly from inner surface 22 and proximate ridge 36. At least a portion of each tab 42 is spaced a distance from inner surface 22 and is substantially parallel therewith. Consequently, a gap 44 is formed between each tab 42 and inner surface 22. Tabs 42 extend toward interior edge 26 of cover 10 and are provided to engage an outer edge of one of vanes 16 on vent diffuser 12, as will be hereinafter described.

Figure 9:
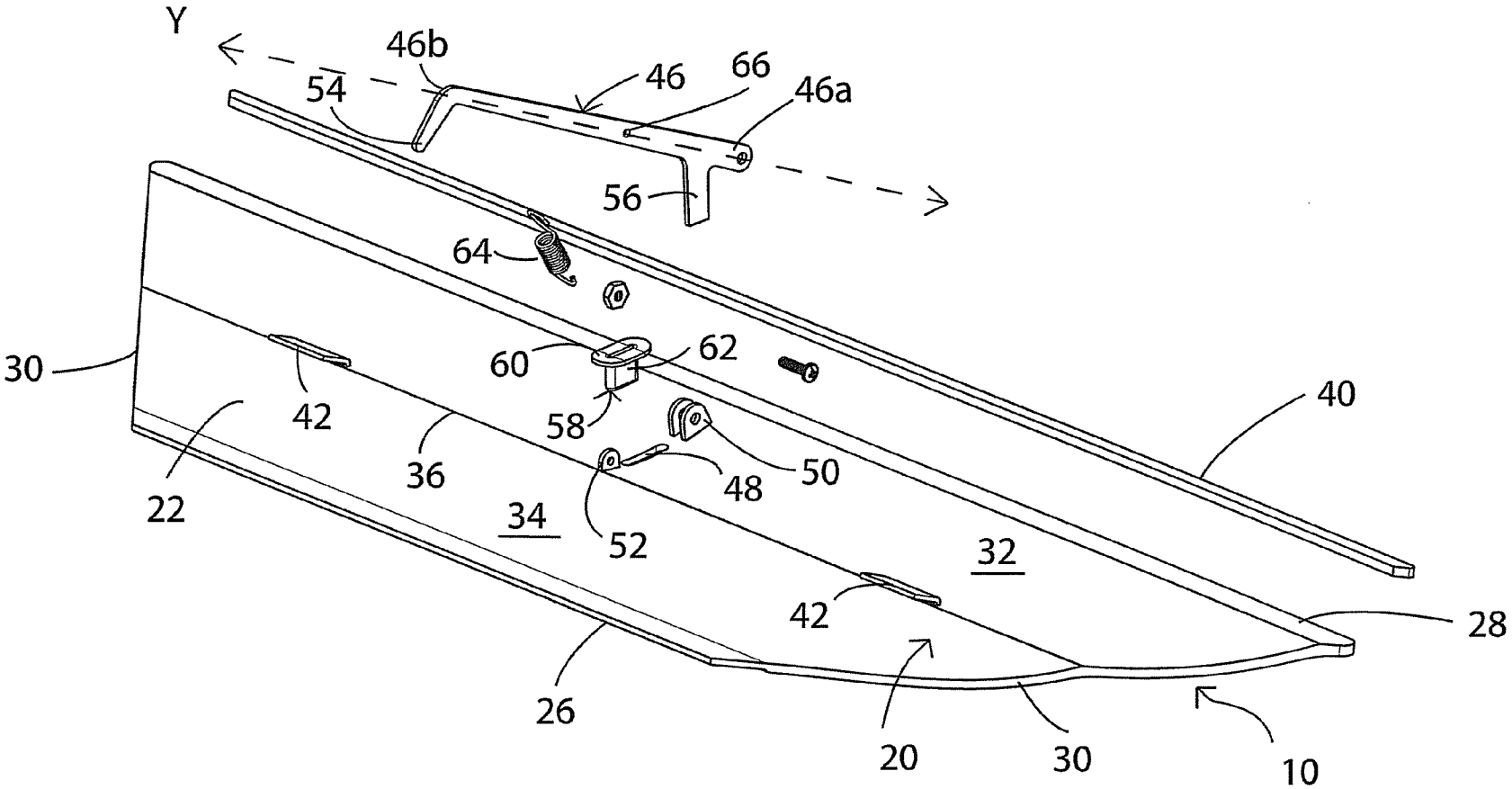
FIG. 9 is an exploded rear view of the vent cover.

Cover 10 is also provided with a locking mechanism for securing it to vent diffuser 12. The locking mechanism comprises an articulated hook 46 that is engaged with flexible member 20. An aperture 48 is defined in first region 32 of flexible member 20. At least one first mounting bracket 50 extends outwardly from inner surface 22 of flexible member 20 adjacent a first end of aperture 48. At least one second mounting bracket 52 extends outwardly from inner surface 22 of flexible member 20 adjacent a second end of aperture 48. Hook 46 is a generally L-shaped member having a first end 46*a* (FIG. 9) that is pivotally secured to first mounting bracket 50 and a second end 46*b* remote from said first mounting bracket 50. Second end 46*b* includes a leg 54 that extends inwardly toward inner surface 22 of flexible member 20 when hook 46 is secured to first mounting bracket 50. Leg 54 extends outwardly from second end 46*b* at an angle of between 80 degrees and 120 degrees to the longitudinal axis "Y" thereof. Hook 46 is also provided with an arm 56 that extends toward inner surface 22 of flexible member 20. Hook 46 is spaced a distance inwardly from first end 46*a*. Arm 56 extends outwardly from hook 46 at an angle of between 70 degrees and 120 degrees to the longitudinal axis Y. As shown in FIG. 9, leg 54 and arm 56 extend outwardly from hook 46 in opposite directions to each other. An end of arm 56 projects through aperture 48 in flexible member 20 and extends for a short distance beyond outer surface 24 thereof. A rubber cap 58 is provided for the end of arm 56. As shown in FIG. 9, cap 58 preferably includes a lip 60 that abuts inner surface 22 of flexible member 20 and a cup region 62 that retains the end of arm 56 therein. Cup region 62 projects outwardly through aperture 48. Cup region 62 and the end of arm 56 retained therein form a release button that is engageable to manipulate the position of hook 46. A spring 64 is secured at one end to second mounting bracket 52 and at another end is received through hole 66 (FIG. 9) in hook 46. Spring 64 is provided to keep leg 54 of hook 46 biased toward inner surface 22 of flexible member 20.

Figure 2:
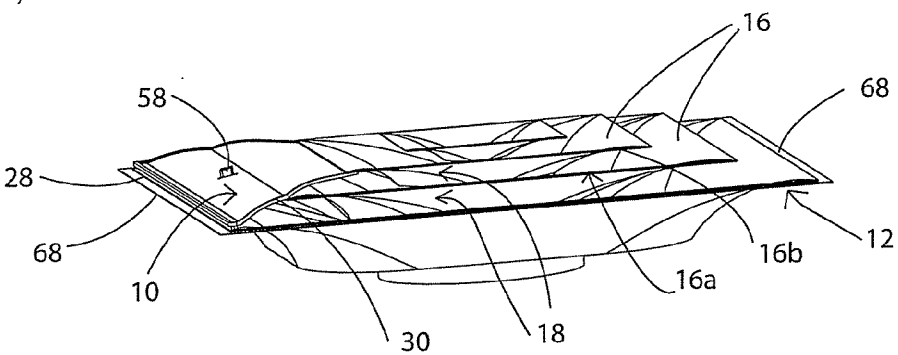
FIG. 2 a perspective front view of the four-vane diffuser taken from a slightly different angle with the ceiling removed for clarity, and showing the openings between the vanes of the vent diffuser.
Figure 4:
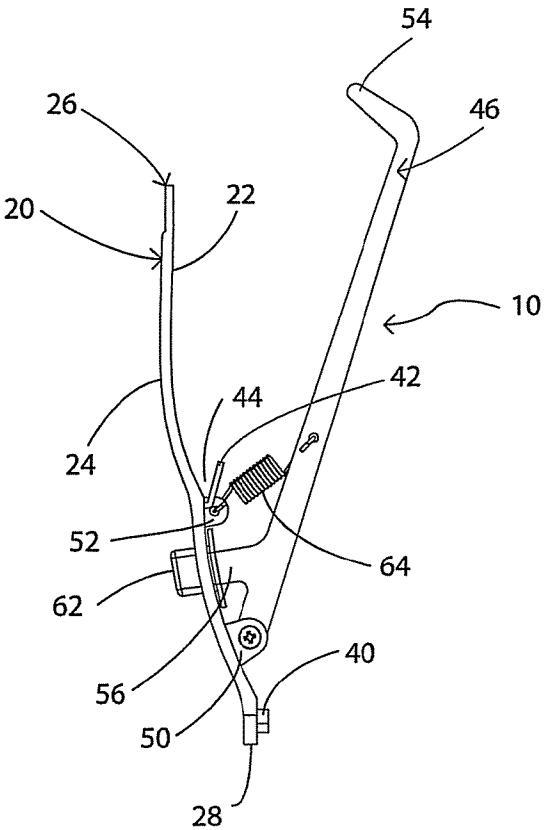
FIG. 4 is a side view of the vent cover of FIG. 3.
Figure 3:
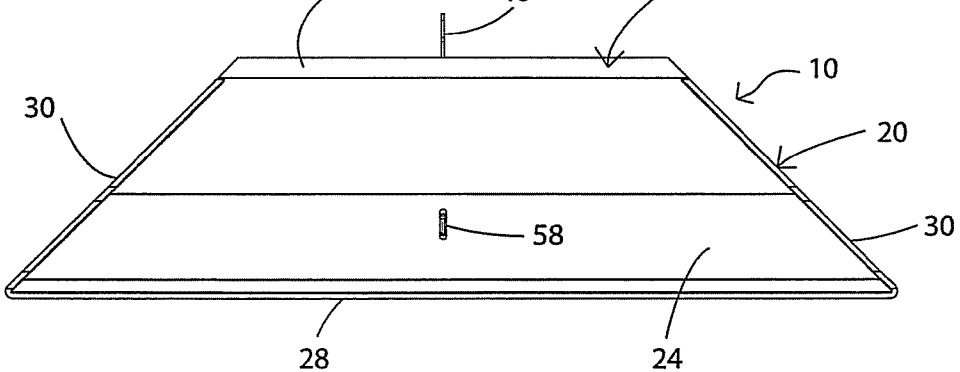
FIG. 3 is a front view of the vent cover in accordance with the present invention.
Figure 5:
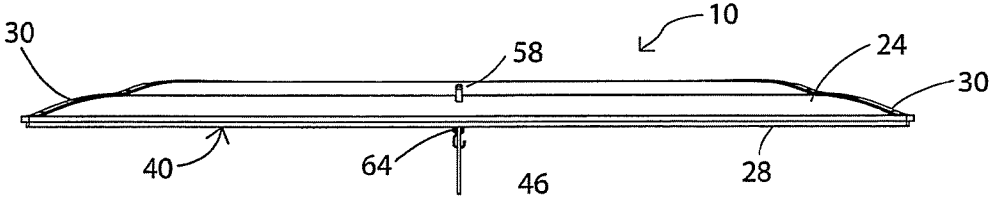
FIG. 5 is an end view of the vent cover.
Figure 8:
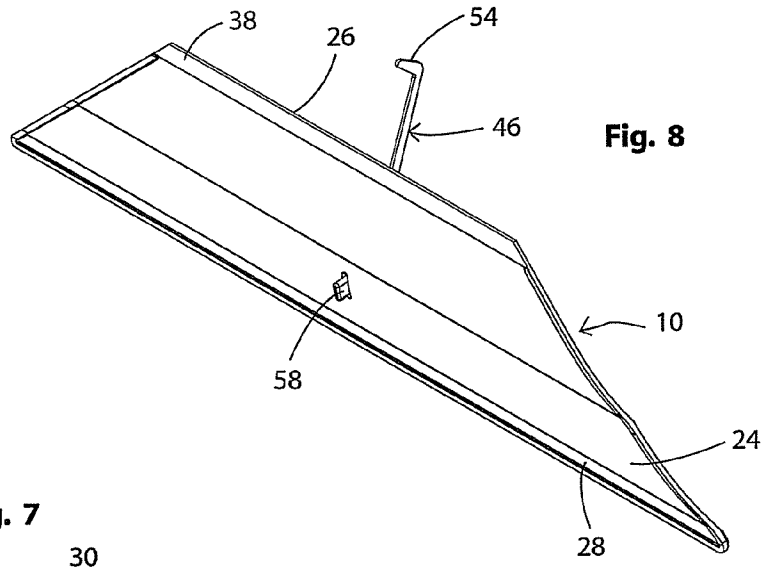
FIG. 8 is a second perspective front view of the vent cover showing the leg and hook of the locking mechanism extending rearwardly from the cover.
Figure 7:
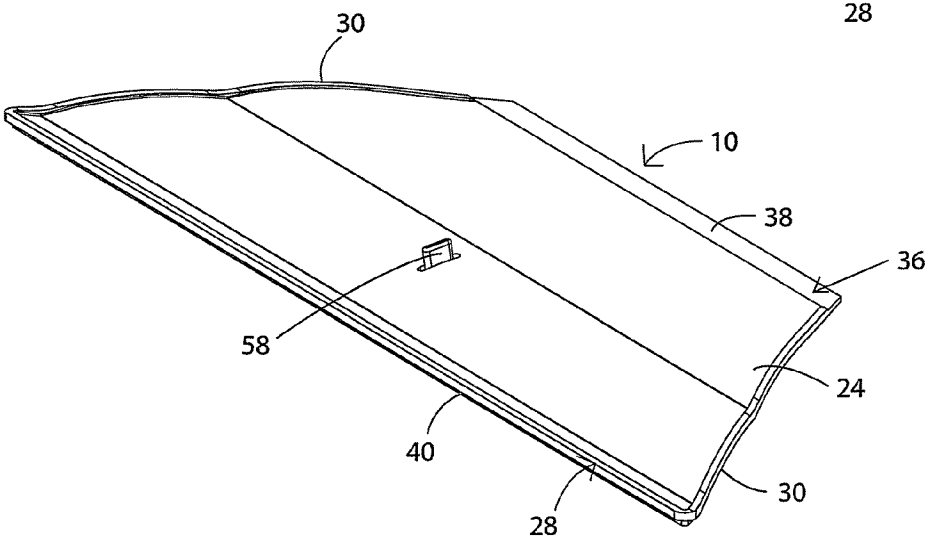
FIG. 7 is a perspective front view of the vent cover showing the release button extending from the outer surface of the cover.
Figure 12:
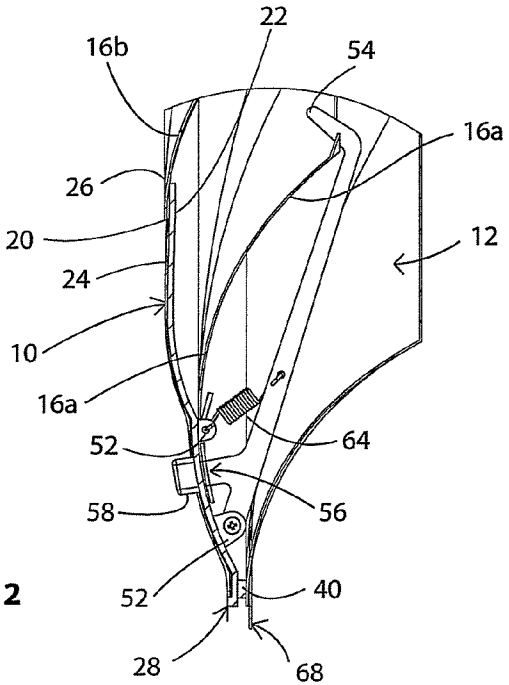
FIG. 12 is an enlargement of the highlighted region of FIG. 11 and showing a portion of the vent cover in cross-section.
Figure 11:
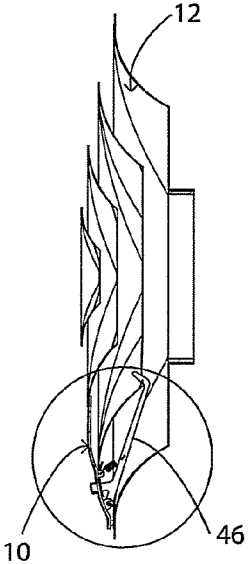
FIG. 11 is a side view of the diffuser and vent cover taken through line 11-11 of FIG. 10.
Figure 10:
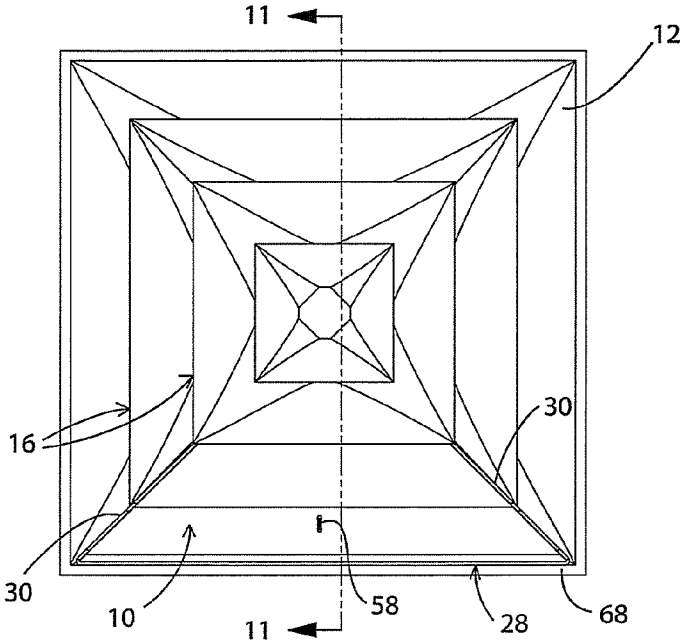
FIG. 10 is a front view of the diffuser with the vent cover installed thereon.

Cover 10 is installed on vent diffuser 12 quickly and easily. In order to install cover, flexible member 20 is slid onto vent diffuser 12 from one side with cover 10 being held at an upward angle so that hook 46 and tabs 42 slide between first and second vanes 16*a*, 16*b* (FIGS. 1, 2 and 12). As shown in FIG. 12, tabs 42 engage the outermost edge of first vane 16*a*. More specifically, tabs 42 slide under the bottom surface of the outermost edge of first vane 16*a* thereby causing the outermost edge of first vane 16*a* to be captured between tabs 42 and inner surface 22. Leg 54 of hook 46 engages the innermost edge of the first vane 16 and becomes hooked thereunder. Lip 38 of interior edge 26 slides under the bottom surface of the outermost edge of second vane 16*b*. Because of the shape of flexible member 20 with the slight arcuate bowing of first and second regions 32, 34, the spring memory in the plastic of member 20 keeps lip 38 forced against the bottom surface of second vane 16*b*. Foam strip 40 is seated on the outermost surface of rim 68 of vent diffuser 12. Strip 40 acts as a seal to substantially prevent air from flowing between cover 10 and rim 68. Strip 40 also acts as a dampener and substantially prevents cover 10 from vibrating and rattling against vent diffuser 12 air flowing through diffuser 12 buffets cover 10. Cover 10 substantially blocks off openings 18 between vanes 16 in the region of vent diffuser 12 over which it is applied. The person installing cover 10 will be able to confirm that flexible member 20 is secured onto diffuser 12 because the release button formed by arm 56 and cap 58 extends outwardly from outer surface 24 to a greater degree than when cover 10 is detached from diffuser 12.

Figure 14:
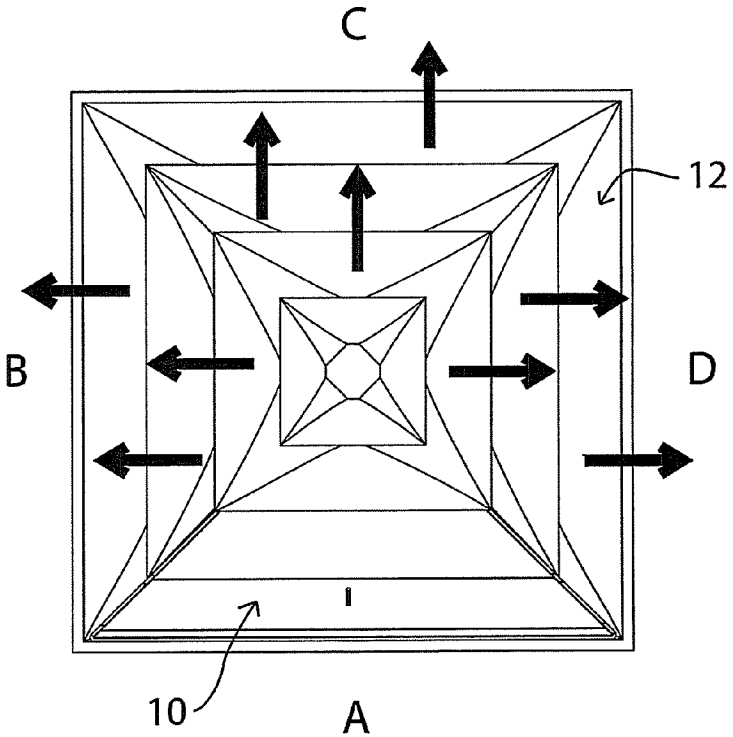
FIG. 14 is a front view of the vent diffuser with a cover installed thereon and showing the airflow pattern from the diffuser.
Figure 13:
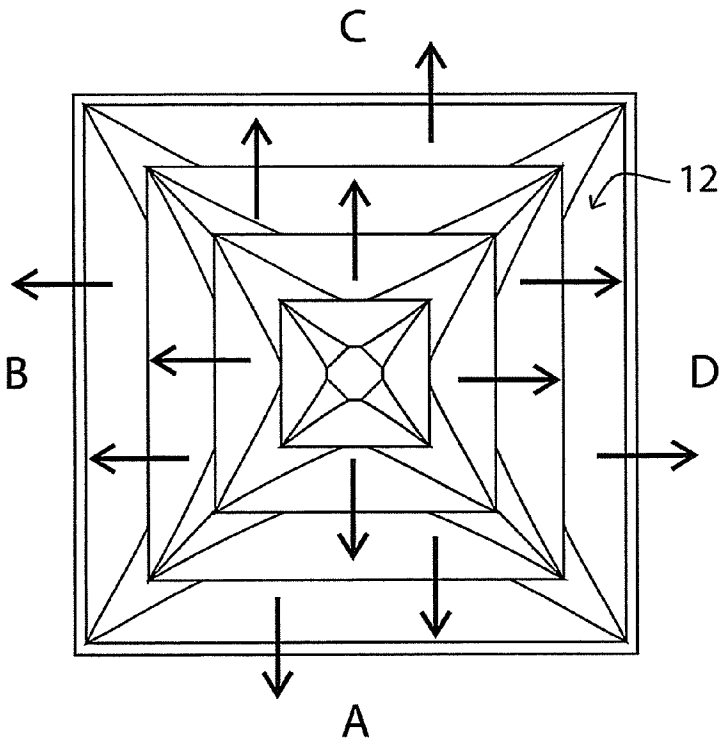
FIG. 13 is a front view of the vent diffuser without a cover installed thereon and showing the airflow pattern from the diffuser.
Figure 15:
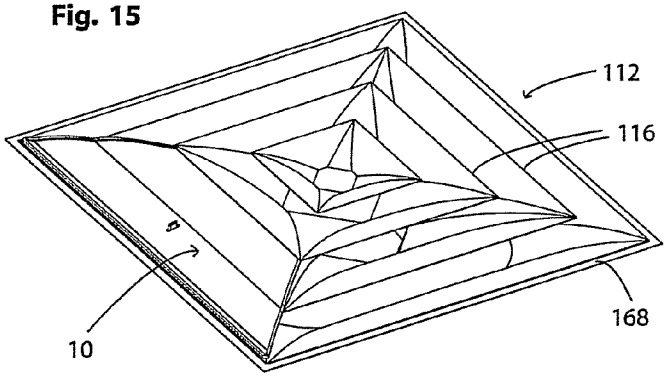
FIG. 15 is a perspective front view of a three-vane diffuser with the vent cover installed thereon.
Figure 16:
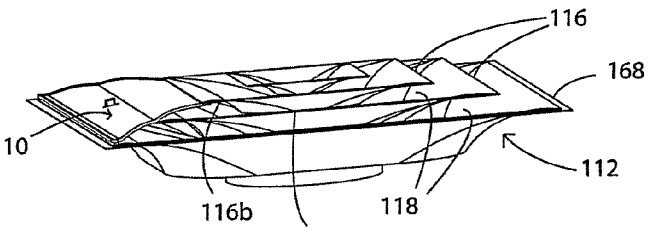
FIG. 16 is a perspective front view of the three-vane diffuser taken from a slightly different angle and showing the vent cover installed thereon.
Figure 18:
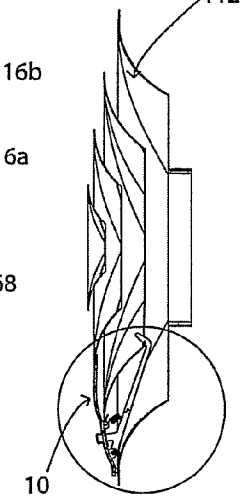
FIG. 18 is a side view of the diffuser and vent cover taken through line 18-18 of FIG. 17.
Figure 19:
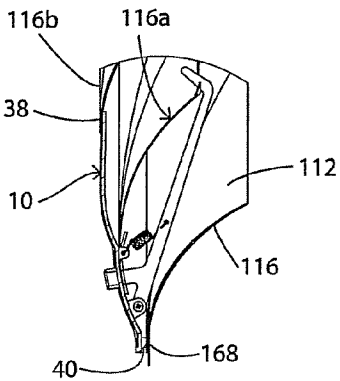
FIG. 19 is an enlargement of the highlighted region of FIG. 18
Figure 17:
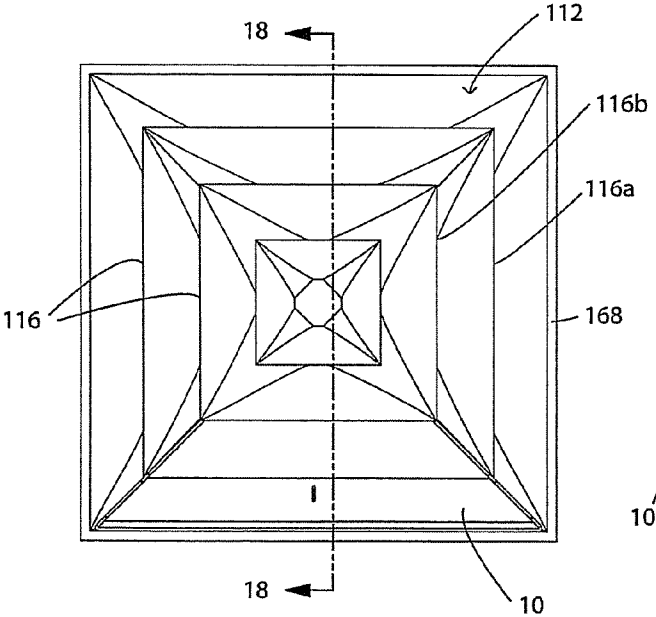
FIG. 17 is a front view of the three-vane diffuser with the vent cover installed thereon.

Cover 10 is designed to affect airflow from diffuser 12. FIG. 13 shows diffuser 12 before a cover 10 is installed thereon. Diffuser 12 is shown divided generally into four quadrants that are labeled A, B, C and D. The arrows illustrate air flowing out of vent diffuser 12 in all four quadrants. FIG. 14 shows vent diffuser 12 after cover 10 has been installed in one quadrant thereof. In this figure, quadrant A has been closed off by cover 10. It can be seen that the airflow from vent diffuser 12 has been changed in that air no longer flows out of quadrant A, but continues to flow out of quadrants B, C, and D. Furthermore, while quadrant A is blocked off, the rate of air flowing out of the vent diffuser 12 does not change, the volume and rate of airflow from the remaining quadrants B, C and D is increased relative to the condition shown in FIG. 13. This increase in the rate of airflow is signified by the larger arrows in FIG. 14. It will be understood that more than one cover 10 may be applied to vent diffuser 12 to change the airflow therefrom. If four separate covers are installed on vent diffuser 12, airflow from vent diffuser 12 will be substantially completely cut off.

When it is desired to remove cover 10, the cap 58 is pushed inwardly toward outer surface 24 of flexible member 20. This inward movement causes hook 46 to pivot about the connection point of hook 46 with second mounting bracket 52. Leg 54 is thereby moved outwardly away from the innermost edge of first vane 16*a* and becomes disengaged therefrom. Cover 10 may then be slid off vent diffuser 12.

FIGS. 15-19 show cover 10 installed on a vent diffuser 112 that has three vanes 116 instead of four. Vanes 116 have openings 118 between them through which air can flow. Cover 10 is exactly the same cover that is applied to vent diffuser 12. Lip 38 slides under the bottom surface of vane 116*b*. Tabs 42 slide under the bottom surface of the outermost edge of vane 116*a* while leg 54 engages the bottom surface of the innermost edge of vane 116*a*. Strip 40 rests on rim 168 of diffuser 112. Cover 10 is applied to diffuser 112 in the same manner as to diffuser 12. Cover 10 is also removed therefrom in like manner.

Cover 10 is of a truncated triangular shape so as to be complementary to the shape of a quandrant of a square diffuser 12. It will be understood that the cover can be manufactured to be complementary to a region of a round diffuser (not shown). This cover may be designed to block one quarter of a round vent diffuser or one third of a round vent diffuser. In the first instance, the cover is designed to block off 90° of the vent diffuser and four covers will completely prevent airflow from the vent diffuser. The cover may, instead, be designed to block off 120° of the round vent diffuser. In this instance, three covers may be used to completely prevent airflow from the vent diffuser.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A device for altering the airflow pattern from a ceiling vent diffuser having an interior surface and an exterior surface and where the airflow through the diffuser is from the interior surface and toward the exterior surface thereof, said device comprising:

a flexible member; having an inner surface and an outer surface;

a locking mechanism extending from the inner surface and being adapted to detachably engage at least one vane on the exterior surface of the vent diffuser and to thereby be retained thereon; said flexible member obscuring a region of openings in the vent diffuser and thereby substantially preventing air from flowing out of that region of the vent diffuser; and wherein the locking mechanism comprises:

at least one tab fixedly secured to the inner surface of the flexible member and extending outwardly therefrom, said at least one tab in cooperation with the inner surface of the flexible member being adapted to engage a first edge of one of the vanes; and a hook member pivotably secured to the inner surface of the flexible member and extending outwardly therefrom, said hook member being resiliently biased to engage a second edge of one of the vanes.

2. The device as defined in claim 1, wherein said flexible member is generally planar.

3. The device as defined in claim 2, wherein the flexible member has an interior edge, an exterior edge and side edges extending therebetween, and wherein said interior edge is of a smaller length than said exterior edge.

4. The device as defined in claim 1, wherein the hook member is movable between a first and a second position, and when said hook member is in the first position, the edge of the associated vane is clamped between the inner surface of the device and the hook member; and when the hook member is in the second position, the edge of the associated vane is released therefrom.

5. The device as defined in claim 4, wherein said hook member is pivotally mounted at a first end to the inner surface of the flexible member; and the device further comprises:

a spring secured at one end to the inner surface of the flexible member and at an opposite end thereof to the hook member, and wherein said spring biases the hook member toward the inner surface of the flexible member.

6. The device as defined in claim 5, further comprising a leg disposed at a second end of the hook member and at an angle to a longitudinal axis of the hook member, and wherein the leg extends inwardly toward the inner surface of the flexible member.

7. The device as defined in claim 6, further comprising:

an aperture defined in the flexible member; and an arm extending outwardly from the first end of the hook member and extending generally in the same direction as the leg; and wherein at least a portion of the arm extends through the aperture in the flexible member and projects for a distance beyond the outer surface thereof.

8. The device as defined in claim 7, wherein the arm is disposed at an angle to the longitudinal axis of the hook member, and wherein the leg angles outwardly from the clamping member in a first direction relative to the longitudinal axis and the arm angles outwardly from the clamping member in a second direction relative to the longitudinal axis.

9. The device as defined in claim 8, wherein the arm and leg diverge outwardly away from each other.

10. The device as defined in claim 7, further comprising a cap member, said cap member being positionable on the portion of the arm that extends through the aperture, whereby the portion of the arm and cap member comprises a release button that is activatable to release the clamping member from the vent diffuser.

11. The device as defined in claim 3, further comprising a sealing member disposed along the exterior edge of the flexible member and on the inner surface thereof, said sealing member being adapted to engage an outer rim of the vent diffuser.

12. The device as defined in claim 1, wherein the flexible member is manufactured from one of a transparent, a non-transparent and a colored plastic.

13. The device as defined in claim 1, wherein the flexible member is configured to be complementary in shape to the region of one of a square and a round vent diffuser.

14. The device as defined in claim 1, wherein the at least one tab and the hook member engage the same vane.

15. In combination:

a ceiling vent diffuser adapted to be disposed adjacent a vent outlet of a heating or cooling system, said ceiling vent diffuser having an interior surface adapted to be disposed adjacent the vent outlet and an exterior surface adapted to be remote from the vent outlet; and wherein air flowing through the system flows in a direction from the interior surface of the ceiling vent diffuser to the exterior surface thereof;

an air deflector releasably engageable with the ceiling vent diffuser and positionable adjacent the exterior surface thereof, said air deflector being configured to alter the direction of air flowing outwardly from the ceiling vent diffuser while keeping the quantity of air flowing outwardly therefrom substantially the same as if the deflector was not engaged with the ceiling vent diffuser; and wherein the air deflector comprises:

a flexible member that is generally planar in cross-section and has an inner surface and an outer surface, and wherein the inner surface of the flexible member is disposed adjacent the exterior surface of the ceiling vent diffuser;

a locking mechanism provided on the inner surface of the air deflector, said locking mechanism selectively being engageable with the ceiling vent diffuser to retain the air deflector on the ceiling vent diffuser, and wherein the locking mechanism is disposed between the ceiling vent diffuser and the air deflector when so engaged; wherein the locking mechanism comprises:

at least one tab fixedly secured to the inner surface of the flexible member at a first location, and wherein the tab extends outwardly from the inner surface, the at least one tab releasably engaging a first edge of one of a plurality of vanes in cooperation with an inner surface of the flexible member; and a hook member pivotably secured to the inner surface of the flexible member at a second location, said hook member extending outwardly from the inner surface, and wherein the second location is spaced a distance from the first location, said hook member being resiliently biased to engage a second edge of the one of the vanes.

16. The combination as defined in claim 15, wherein the at least one tab and the hook member are free of connections to each other.

17. The combination as defined in claim 15, wherein the hook member is pivotally secured to the inner surface of the flexible member.

18. The combination as defined in claim 17, further comprising a coil spring having a first end secured to the inner surface of the flexible member and a second end secured to the hook member.

* * * * *